US006477801B1

(12) United States Patent
O'dwyer

(10) Patent No.: US 6,477,801 B1
(45) **Date of Patent: *Nov. 12, 2002**

(54) FIREARMS SECURITY

(75) Inventor: James Michael O'dwyer, Brisbane (AU)

(73) Assignee: Metal Storm Limited, Brisbane (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/445,024

(22) PCT Filed: Jun. 2, 1998

(86) PCT No.: PCT/AU98/00413

§ 371 (c)(1),
(2), (4) Date: Dec. 3, 1999

(87) PCT Pub. No.: WO98/55817

PCT Pub. Date: Dec. 10, 1998

(30) Foreign Application Priority Data

Jun. 3, 1997 (AU) ..... P07159

(51) Int. Cl.[7] ..... F41A 17/00; F41A 19/00

(52) U.S. Cl. ..... 42/70.11; 42/70.01; 42/84; 89/28.05

(58) Field of Search ..... 89/28.05; 42/70.01, 42/70.11, 84

(56) References Cited

U.S. PATENT DOCUMENTS

| | | | | | |
|---|---|---|---|---|---|
| 3,854,231 | A | | 12/1974 | Broyles | 42/84 |
| 4,970,819 | A | | 11/1990 | Mayhak | 42/70.11 |
| 5,062,232 | A | | 11/1991 | Eppler | 42/70.11 |
| 5,123,193 | A | | 6/1992 | Pugh | 42/70.11 |
| 5,303,495 | A | * | 4/1994 | Hartcock | 42/70.11 |
| 5,461,812 | A | | 10/1995 | Bennett | 42/70.11 |
| 5,502,915 | A | | 4/1996 | Mendelsohn et al. | 42/70.11 |
| 5,570,528 | A | | 11/1996 | Teetzel | 42/70.11 |
| 5,603,179 | A | | 2/1997 | Adams | 42/70.08 |
| 5,883,329 | A | | 3/1999 | O'dwyer | 102/217 |
| 5,915,936 | A | * | 6/1999 | Brentzel | 42/70.11 |

FOREIGN PATENT DOCUMENTS

| | | |
|---|---|---|
| RU | 94017593 | 4/1996 |
| RU | 2072072 | 1/1997 |
| WO | WO 94/20809 | 9/1994 |

* cited by examiner

*Primary Examiner*—J. Woodrow Eldred
(74) *Attorney, Agent, or Firm*—Oblon, Spivak, McClelland, Maier & Neustadt, P.C.

(57) ABSTRACT

This invention provides security measures for electronically operated munitions and firearms such as the pistol (10). The electronic controls (18) may be armed or disarmed electronically and provided with encoding means which arms the electronic controls to enable firing of the secured weapon upon the monitoring authorised code. This code may be electronically personalised to the individual. The code may be provided by a swipe card or the like carried by the authorised personnel. Alternatively the code may be biometric data which retains a lifelong distinctive identity of the authorised personnel.

27 Claims, 4 Drawing Sheets

FIREARMS SECURITY

TECHNICAL FIELD

The invention relates to arming of munitions and firearms.

In the United States it has been estimated that 60% of all gun deaths occur because of non-owner use of weapons, these deaths include a child suicide by use of a handgun every eight hours, and that every three years more children die from gunshot injuries than US troops killed during the Vietnam war.

It is also estimated that firearms in homes are forty-three times more likely to kill a family member than an intruder. One in four homes has a handgun making a total of 70 million homes with handguns of which it is estimated that 40% are left unlocked in homes.

Thus there is clearly a need for weapons which can only be armed for use by authorised users.

BACKGROUND ART

Several attempts have been made over the years to provide weapons which can be disarmed, such that they can not function in the hands of unauthorised users, by the addition of locking/keying technology but these have not proved successful.

It is understood that the Justice Department in the U.S. has funded a program with Colt's Manufacturing to pursue an electronic disarming system for disabling the existing mechanical system on hand guns. However the resultant guns are heavy and bulky, are less reliable, and are expensive. Furthermore the inconvenience of arming and disarming such guns would tend to discourages regular use of the disarming system.

Moreover and importantly it is difficult to lock the mechanical operating mechanism electronically for simple safe and reliable operation and generally the link between the electronic lock and the mechanics of such guns is not very difficult to defeat.

This invention aims to alleviate at least one of the above disadvantages and to provide armable and disarmable munitions and firearms which will be reliable and efficient in use.

DISCLOSURE OF INVENTION

With the foregoing in view this invention in one aspect resides broadly in electronically operated munitions and firearms having electronically coded arming means for activating the electronics which cause firing.

Suitably the electronically operated munitions and firearms are of the type having a plurality of projectiles stacked axially within a barrel together with discrete selectively ignitable propellant charges for propelling the projectiles sequentially through the muzzle of the barrel and in which selective ignition of the propellant charges is electronically controlled. Such firearms will be referred to hereinafter as of the type described.

More preferably the electronically operated muinitions and firearms are of the type described in my International Patent Applications Nos.: PCT/AU94/00124 (now U.S. Pat. No. 5,883,329 and divisional patent U.S. Pat. No. 6,123,007) and PCT/AU96/00459 (now U.S. Pat. No. 6,138,395) and co-pending patent applications in my name and which typically include a number of barrels packed in a tight group, without any mechanical firing mechanisms.

In small handguns of this type, which may be operated by a small electronic controller, it is preferred that the pistol grip or butt house electronic controls as well as the electronically coded arming means. If desired part of the electronics and especially the coded arming means may be supported in a removable section similar to a plug-in "magazine".

For example, the coded arming means in the plug-in electronic insert may be electronically personalised to the individual and carried separately for insertion into a weapon to arm the weapon. Alternatively the coded arming means may be a swipe card or the like carried by the authorised personnel for arming weapons by associating the card with the weapon in the appropriate manner.

The electronics could be programmed to activate authorised weapons only, and preferably the electronics in either or both the weapon and the authorised persons card or other removable coded arming means contain a safe memory which could be interrogated by authorised audit personnel only, to provide such information as date, time of each firing associated with the particular magazine/insert etc.

The weapon or the electronic insert could be provided with a key pad or a card swipe or either could be programmed to recognize biometric data which retains a lifelong distinctive identity of the authorised personnel, and preferably which may be analysed quickly and non-invasively, to provide an arming signal when authorised personnel are sensed as being in control of the weapon. If desired, a personalised transducer could be secured on the body of the authorised personnel or on their clothing to provide arming of the weapons which the authorised person is entitled to use.

For this purpose the magazine/insert or weapon would contain lenses, transducers or contact patches, for example, such as for verifying matching eye details, voice recognition or a fingerprint or other biometric data which are characteristic to each individual.

In one form the electronic magazine/insert or weapon would contain position electronics, such as GPS such that place and or direction of firing could also be recorded for subsequent interrogation. This technology can give real time activity data for relay to a control center, either in battle or training.

In this manner the issuing of firearms or electronic activators for same, as in the form of a plug-in magazine/insert, could be accompanied by a personalising program for the activator, whereafter if desired, every firing, including place, time, date, direction, etc. would be recorded.

It is also preferred that an LCD screen be provided so that the operator can call up an array of recorded and operating information. This may include, for example, reminders for reloading, cleaning and license renewal, all weapon settings, including rounds remaining, weapon readiness state and diagnostics.

Handguns would suitably be provided with audio capability built into the electronics, whereby the weapon would be set to audibly confirm all settings etc. For instance, for home defence, it may well be an advantage to have a weapon the announces "Weapon Active, Safety Off" etc. The owner would be sure of the condition of the weapon, and so would any intruder.

For some applications, such as for military or civil use it is also preferred that the electronics be provide with remote arming/disarming functions. This would enable authorised persons to remotely deactivate all weapons within a given area to provide a safe area, or to selectively provide safe and active areas in which weapons were armed.

As well, although much more important for larger military weapons, the electronics may incorporate any of a range of sensors at the muzzle, to confirm, for example, that a round has left the muzzle when fired. If a hang fire occurs, or a parked projectile exists, the electronic sensors, being on the same circuit as the firing impulse, can automatically disable the barrel before another round is fired, and also provide a message to the operator.

The sensors can focus on any of a number of events that confirm the projectile that's been fired has left the barrel. Upon firing a metal mass passes the muzzle. There's also a pressure event, a temperature event, a recoil event, a visible and invisible radiation event, and a gas jetting event. All these could be sensed and utilised as desired.

In such weapons which utilise full electronic operation there are no mechanical moving operating parts and if the weapons electronics can't be accessed, the weapon cannot be operated. The electronics can't be bypassed to permit operation of the mechanical system, as none exists and damaging the electronics in any attempt to operate the weapon will also render the weapon unserviceable. Furthermore no unauthorised individual can operate the weapon, and unauthorised resale may also be prevented as an up to date database could be maintained with correspondence of recorded owner/user information required to complete a transaction, require re-programming of the new or changed circumstances.

Agency-only access to the weapon's electronic history could also be provided together with agency-only reset of individual weapon keying to control resale and theft. The electronics may also have a permanent disable command and other controls such as electronic selection of rate of fire.

A typical example of the present invention is illustrated in the drawings attached hereto. However this invention could equally be applied to fixed weapon installations in vehicles, ships and aircraft. In the accompanying drawings, FIG. 1 illustrates a pistol with a magazine/insert in the retracted attitude;

Figure 1:
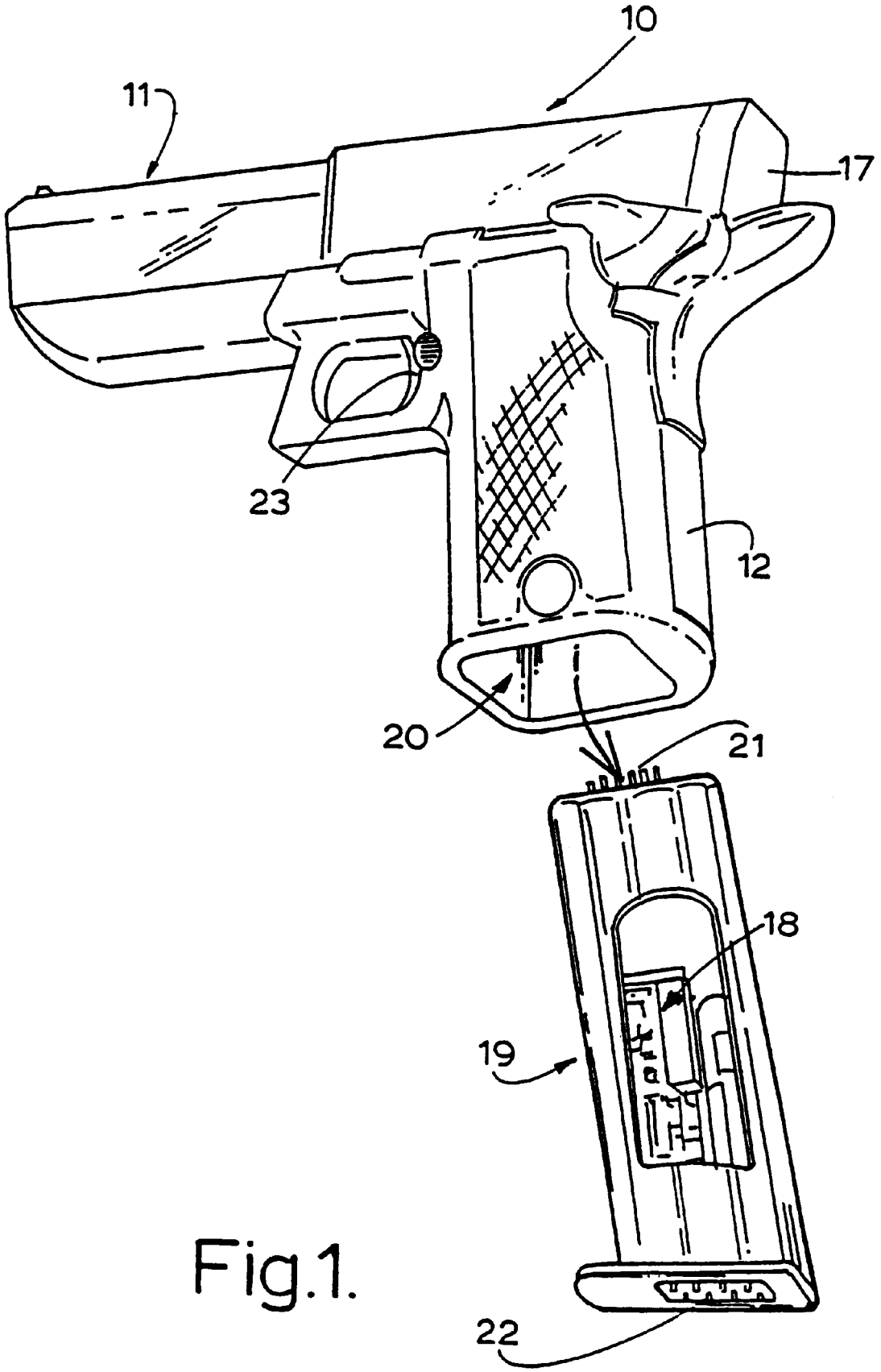
Figure 2:
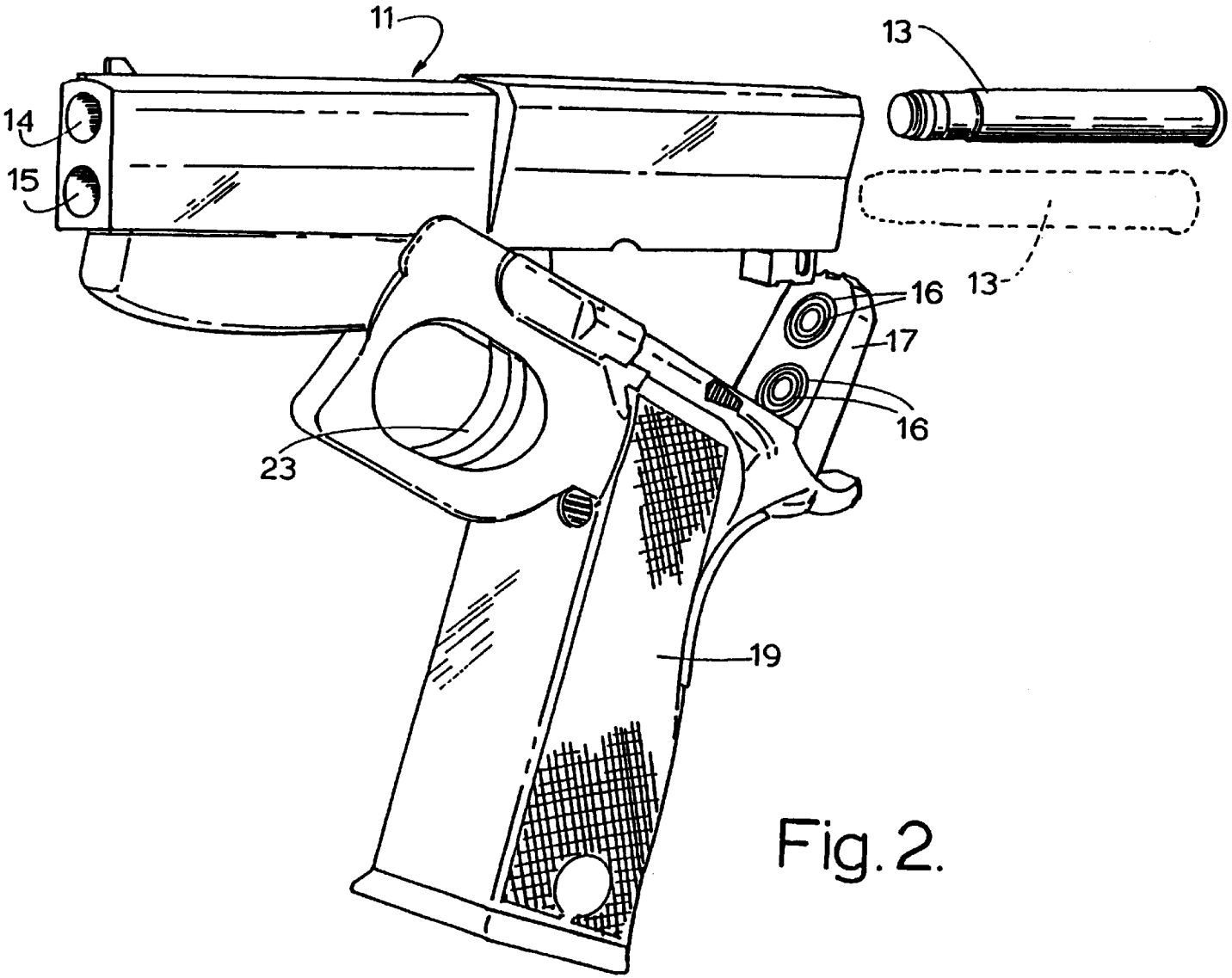
FIG. 2 illustrates the pistol in a broken attitude for loading purposes.

The pistol assembly 10 illustrated in FIGS. 1 and 2 of the drawings has a barrel assembly 11 which contains an upper and a lower barrel which may be broken with respect to the pistol grip 12 to enable cartridges 13 to be separately loaded into the respective barrels 14 and 15.

When the barrel assembly 11 is closed, the rear ends of the cartridges 13 make electrical contact with complementary concentrically disposed connectors 16 in the fixed butt plate 17 and connected to electronic controls 18 supported in a removable insert 19 supported as a removable plug-in insert in a complementary recess 20 in the pistol grip 12.

The electronic controls 18 contain the battery powered electronic firing controls, memory for storing recorded data and other required electronics for single firing, repeat or selective automatic control upon actuation of the trigger 23, and including diagnostics and security device sensors enabling activation of the controls 18.

It will be seen that the plug-in insert 19 includes a multipin connector 21 at its inner end which engages with a complementary connector when the insert is pushed into the recess 20 in the handgrip 12 to the fully home position.

Figure 3:
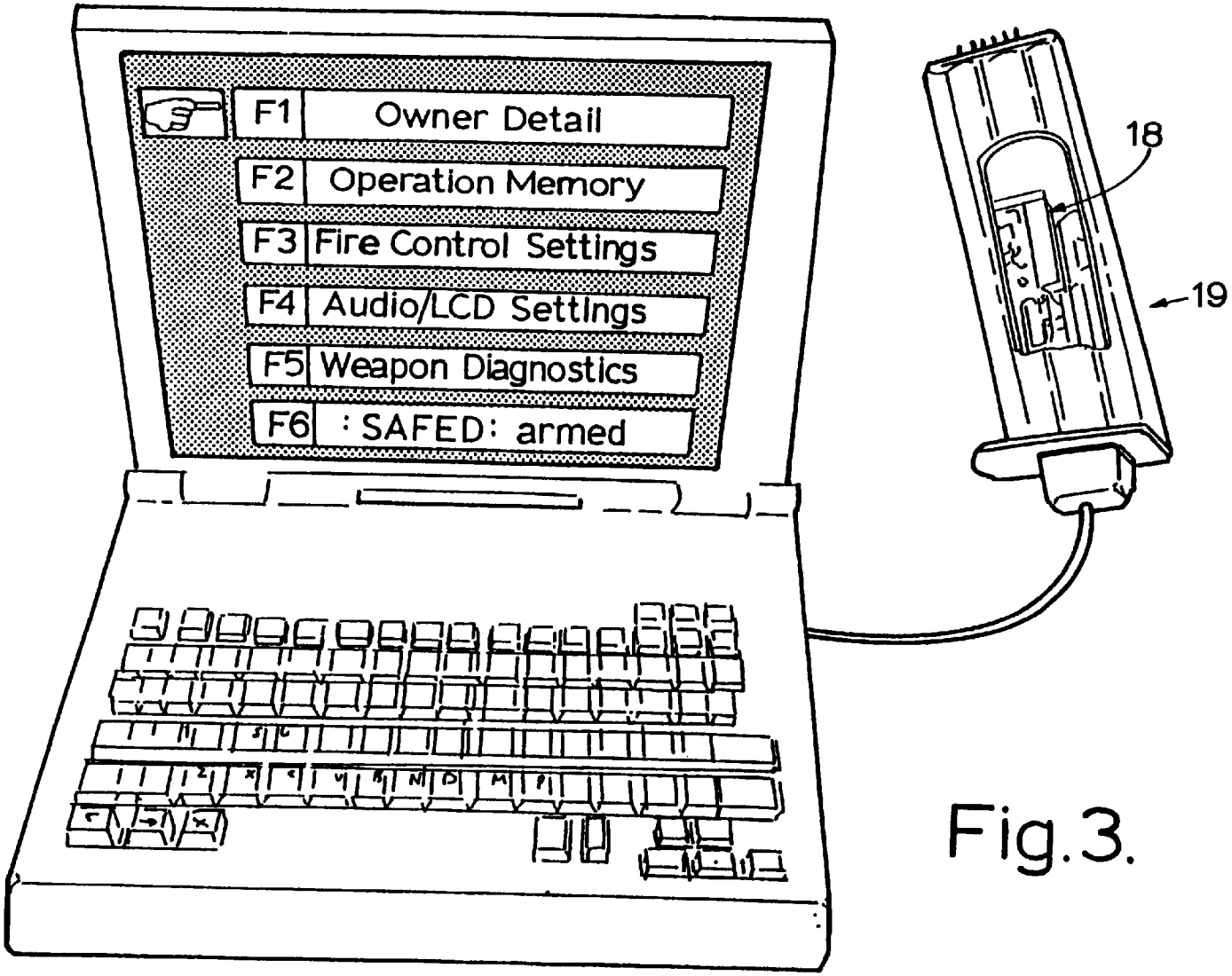
FIG. 3 illustrates a typical means of downloading information which may be stored in the magazine type insert.

At the base of the insert 19, a further multipin connector 22 is provided to enable the electronics therein to be accessed through a computer as illustrated in FIG. 3. Such access enables programming of the electronics and display of stored data for desired functions and results on the screen 18.

The removable insert 19 may contain the entire electronic controls for the weapon. Alternatively, some of the controls may be embedded in a non-removable part of the hand gun such that overriding controls may prohibit operation of the weapon where functions of the removable insert 19 do not correspond with the non-removable electronics contained in the hand gun.

Figure 4:
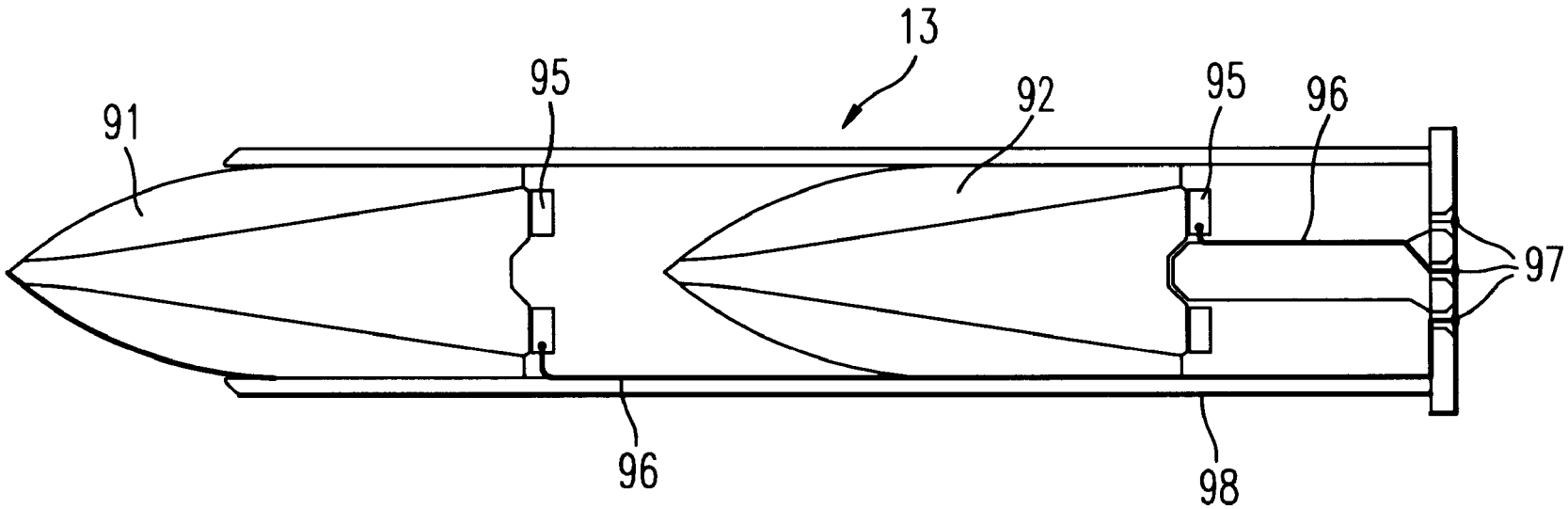
FIG. 4 illustrates a replaceable cartridge having a plurality of projectiles stacked axially therein.

An example is shown in FIG. 4 of a replaceable cartridge having axially stacked front and rear projectiles 91 and 92 and having electrically operated primers 95 connected by leads 96 to contacts 97 for completing the firing circuit formed by the leads 96 and the casing 98.

From the above it will be seen that this invention embodies full electronic operation of the weapons including the security. If desired the security system of this invention may also be used with mechanically operated firearms but the same benefits will not be achieved because of the possibility of overriding the electronic to operate the firearm mechanically.

The security system may also be used with firearms having electrically or electronically controlled firing and/or aiming systems, enabling the provision of security on either.

According to this invention, provided the weapon's electronics can not be accessed, the weapon can not be operated. Furthermore damaging of the electronics in an attempt to operate the weapon will also render the weapon unserviceable. In addition unauthorised personnel can not operate a protected weapon which can be monitored for recordal of its operational history and the benefits to a non-law abiding citizen which can be achieved through unauthorised sale is minimised.

The invention may be also applied to replacement munitions which may require a selected level of electronic activation prior to distribution, for example.

It will of course be realised that the above has been given only by way of illustration of this invention and that all such modifications and variations thereto as would be apparent to persons skilled in the art are deemed to fall within the broad scope and ambit of this invention as is defined in the appended claims.

I claim:

1. An electronically operated munition comprising:

a barrel having a muzzle;

a plurality of projectiles stacked axially within the barrel together with electronically controlled discrete ignitable propellant charges for selectively propelling the respective projectiles through the muzzle of the barrel;

an electronic control device configured when armed to produce ignition of said charges upon actuation of a trigger; and a removable section including electronically coded arming means supported in the removable section for sensing authorized users of said munition; wherein said electronically coded arming means is configured to activate the electronic control device which causes ignition of the propellant charges when said trigger is actuated by an authorized user.

2. An electronically operated munition as claimed in claim 1, wherein the electronic control device reverts to an unarmed state when the removable section including the electronically coded arming means is removed from the munition.

3. An electronically operated munition as claimed in either claim 1 or claim 2, wherein:

the munition is configured as a handgun, and the electronic control device is supported in a pistol grip thereof.

4. An electronically operated munition as claimed in claim 1, wherein the entire electronic control device including the electronically coded arming means is removable from the munition.

5. An electronically operated munition as claimed in claim 1, wherein the electronically coded arming means further comprises a key pad.

6. An electronically operated munition as claimed in claim 1, wherein the coded arming means further comprises a personalized swipe card.

7. An electronically operated munition as claimed in claim 1, wherein the coded arming means further comprises a mechanism configured to recognize biometric data of the authorized user.

8. An electronically operated munition as claimed in claim 1, including recording means for subsequent interrogation of events performed by the electronic control device.

9. An electronically operated munition as claimed in claim 1, including position and direction sensing electronics for recording all firing locations and directions.

10. An electronically operated munition as claimed in claim 1, including a screen readout for displaying operating information of the munition.

11. An electronically operated munition as claimed in either claim 1 or claim 2, wherein:

the munition is configured as a rifle, and the electronic control device is supported in a butt thereof.

12. An electronically operated munition as claimed in claim 1, wherein:

the electronic control device incorporates at the muzzle of the barrel sensors responsive to events associated with firing the munition; and the sensors are configured to disarm the electronic control device upon occurrence of an undesired firing event or sequence of events.

13. An electronically operated munition as claimed in claim 12, wherein the event associated with firing is a projectile passing the muzzle.

14. An electronically operated munition as claimed in claim 12, wherein the event associated with firing is a pressure event.

15. An electronically operated munition as claimed in claim 12, wherein the event associated with firing is a recoil event.

16. An electronically operated munition as claimed in claim 12, wherein the event associated with firing is a radiation event.

17. An electronically operated munition as claimed in claim 12, wherein the event associated with firing is a gas jetting event.

18. An electronically operated munition as claimed in claim 12, wherein the electronic control device includes an audio capability whereby the munition may be set to audibly confirm operating information of the munition.

19. An electronically operated munition comprising:

a barrel having a muzzle;

a plurality of projectiles stacked axially within the barrel together with electronically controlled discrete ignitable propellant charges for selectively propelling the respective projectiles through the muzzle of the barrel;

an electronic control device configured when armed to produce ignition of said charges upon actuation of a trigger, wherein the electronic control device reverts to an unarmed state when the electronically coded arming means is removed from the munition;

a removable section including electronically coded arming means supported in the removable section of the munition for sensing authorized users of said munition, wherein the electronically coded arming means is configured to activate the electronic control device which causes ignition of the propellant charges when said trigger is actuated by an authorized user; and a range of sensors provided at the muzzle and electrically coupled to the electronic control device, said sensors responsive to events associated with firing the munition and operative to disarm the electronic control device upon occurrence of an undesired firing event or sequence of events.

20. An electronically operated munition as claimed in claim 19, wherein the event associated with firing is a projectile passing the muzzle.

21. An electronically operated munition as claimed in claim 19, wherein the event associated with firing is a pressure event.

22. An electronically operated munition as claimed in claim 19, wherein the event associated with firing is a recoil event.

23. An electronically operated munition as claimed in claim 19, wherein the event associated with firing is a radiation event.

24. An electronically operated munition as claimed in claim 19 wherein the event associated with firing is a gas jetting event.

25. An electronically operated munition as claimed in claim 19, including a screen readout for displaying operating information of the munition.

26. An electronically operated munition as claimed in claim 19, wherein the electronic control device includes an audio capability whereby the munition may be set to audibly confirm operating information of the munition.

27. An electronically operated munition as claimed in either claim 25 or claim 26, wherein the operating information includes a transition from an armed to an unarmed state of the electronic control device and vice versa.

* * * * *

UNITED STATES PATENT AND TRADEMARK OFFICE

CERTIFICATE OF CORRECTION

PATENT NO. : 6,477,801 B1
DATED : November 12, 2002
INVENTOR(S) : James M. O'Dwyer It is certified that error appears in the above-identified patent and that said Letters Patent is hereby corrected as shown below:

Title page,
Item [*] Notice, change "This patent issued on a continued prosecution application filed under 37 CFR 1.53(d)" to -- This patent issued on a request for continued examination under 37 CFR 1.114 --.

Signed and Sealed this

Twenty-ninth Day of July, 2003

JAMES E. ROGAN
*Director of the United States Patent and Trademark Office*